US005211335A

United States Patent [19]

Strid

[11] Patent Number: 5,211,335

[45] Date of Patent: May 18, 1993

[54] NOZZLE FOR SPRAY TUBES

[75] Inventor: Kent Strid, Järbo, Sweden

[73] Assignee: Kvaerner Eureka A/S, Norway

[21] Appl. No.: 777,515

[22] PCT Filed: May 21, 1990

[86] PCT No.: PCT/SE90/00336

§ 371 Date: Nov. 27, 1991

§ 102(e) Date: Nov. 27, 1991

[87] PCT Pub. No.: WO90/15184

PCT Pub. Date: Dec. 13, 1990

[30] Foreign Application Priority Data

May 30, 1989 [SE] Sweden ..... 8901933

[51] Int. Cl.[5] ..... B05B 15/02

[52] U.S. Cl. ..... 239/110; 239/119; 239/447; 239/581.1

[58] Field of Search ..... 239/110, 113, 119, 443, 239/447, 581.1; 222/148

[56] References Cited

U.S. PATENT DOCUMENTS

| | | | |
|---|---|---|---|
| 390,474 | 10/1888 | Greene et al. | 239/581.1 X |
| 700,009 | 5/1902 | Bean | 239/119 X |
| 3,116,882 | 1/1964 | Vork | 239/119 |
| 3,202,360 | 8/1965 | O'Brien | 239/443 X |
| 3,528,611 | 9/1970 | Watson | 239/119 |
| 3,539,106 | 11/1970 | Ramik | 239/447 X |
| 3,955,763 | 5/1976 | Pyle et al. | 239/119 |
| 4,116,386 | 9/1978 | Calder | 239/119 |
| 4,676,435 | 6/1987 | Nesland | 239/119 X |
| 4,819,872 | 4/1989 | Rosenberg | 239/119 |

FOREIGN PATENT DOCUMENTS

| | | | |
|---|---|---|---|
| 3239493 | 5/1983 | Fed. Rep. of Germany | 239/119 |
| 8202501 | 8/1982 | PCT Int'l Appl. . | |
| 0504564 | 2/1976 | U.S.S.R. | 239/119 |
| 1053893 | 11/1983 | U.S.S.R. | 239/119 |
| 1512679 | 10/1989 | U.S.S.R. | 239/119 |
| 1200012 | 7/1970 | United Kingdom . | |

*Primary Examiner*—Andres Kashnikow
*Assistant Examiner*—William Grant
*Attorney, Agent, or Firm*—Quarles & Brady

[57] ABSTRACT

A spray tube nozzle adapted to be cleaned during its operation. The nozzle includes a nozzle head having an inlet connectable to a conduit and an outlet for spraying liquid. Within the nozzle head is located a rotatable element defining a through-hole. The through-hole is shaped in such a way that the opening at one end is of relatively small cross-section and at the opposite end of a relatively large cross-section. The rotatable element is sealingly arranged in the nozzle head and has an external groove. The rotatable element can be positioned in at least a first rotational position to facilitate flow of spraying liquid from the conduit, to the nozzle inlet, and through the through-hole in the rotatable element, to the nozzle outlet for forming spray jets at the outlet. A second rotational position allows liquid to be flushed through the conduit by flow of the spraying liquid from the inlet, through the groove, and exiting the nozzle through a flush hole. A third rotational position allows the through-hole to be flushed by the flow of spraying liquid from the nozzle inlet through the through-hole in a second direction opposite to the first direction.

8 Claims, 2 Drawing Sheets

NOZZLE FOR SPRAY TUBES

BACKGROUND OF THE INVENTION

The present invention relates to a nozzle for spray tubes, and in particular, for spray tubes used in the paper and wood pulp industry to clean filters. Such spray nozzles are commonly utilized in a spray water system where the function of the nozzle is to form a spray jet from liquid contained in a spray tube and direct the spray against a filter cloth to be cleaned or flushed.

Usually, the spray water used to clean the filter cloth contains fibers and other particles, such as metal pieces, plastic pieces etc., since the spray water is recycled many times for cleaning the filter cloth. In order to prevent the nozzles from becoming clogged due to impurities in the spray water, expensive equipment can be installed to clean the water before it reaches the nozzles. This equipment may include spray water filters, bow sieves, or other means for removing unwanted debris from the water. However, in some cases no separate cleaning equipment is installed to clean the spray water before it reaches the spray nozzles and, as a result, the spray nozzles often need to be dismounted for cleaning.

Nozzle cloggings caused by impurities are often the result of some particle larger than the hole in the outlet of the nozzle creating a partial obstruction within the nozzle. When this happens, additional debris, will be unable to pass through the partial obstruction and will begin to form a plug. As spray water continues to pass through the nozzle, the plug grows far into the tube, upstream from the nozzle, until liquid no longer can pass.

In order to clean ordinary nozzles, a valve upstream from the nozzle must be closed and the nozzle must be dismounted before the plug can be removed. Finally, the valve is closed and the nozzle again is installed. The valve may then be reopened and the nozzle is operative. This known method involves interruptions in the operation of the cloth filter cleansing machine in which the nozzles are installed and is therefore an expensive aspect of the machine.

The present invention is designed to alleviate the problems caused by use of nozzles of the prior art and allows efficient and economical removal of debris from both the nozzle and spray tube.

SUMMARY OF THE INVENTION

The invention relates to a nozzle formed and arranged for cleaning during operation. It includes a nozzle head and a rotatable means having a conical hole positioned in the nozzle head between the spray tube and the nozzle outlet for forming a spray jet. The rotatable means is sealingly arranged in the nozzle body such that it may be positioned to allow a spray to pass from the spray tube to the nozzle outlet or may be placed in one of two additional positions to allow cleaning of the conical hole and spray tube. The invention minimizes the need to temporarily discontinue filter spray operations when cleaning the spray tube and nozzle and involves considerably less expense than the installation of spray water purification systems to eliminate the debris in the spray water.

DETAILED DESCRIPTION OF THE INVENTION

Figure 1:
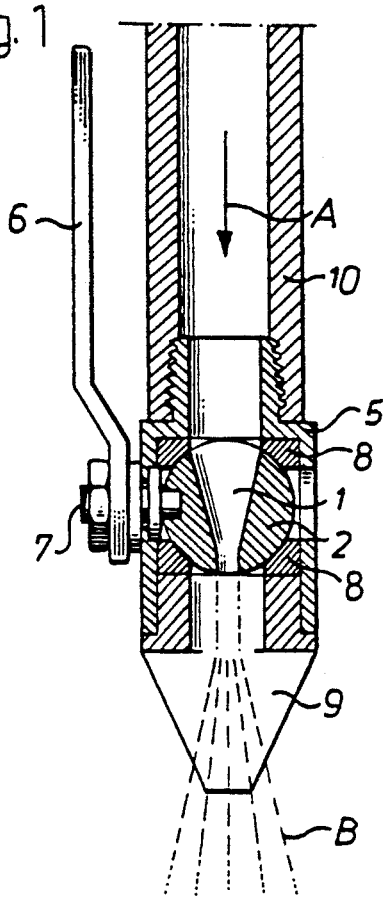
FIG. 1 is a substantially central section through one embodiment of a nozzle according to the invention.

The nozzle constructed in accordance with the present invention is shown in FIGS. 1–6. In FIG. 1, the nozzle includes a nozzle head 5 connected to a spray tube 10. The spray liquid or the spray water flowing toward the nozzle is marked with arrow A and spray jets discharged from the nozzle are marked with the letter B. A spray shaping element 9 is furthermore connected, preferably replaceably connected, to the nozzle head 5, opposite the tube 10, for obtaining a desired spray pattern.

Figure 2:
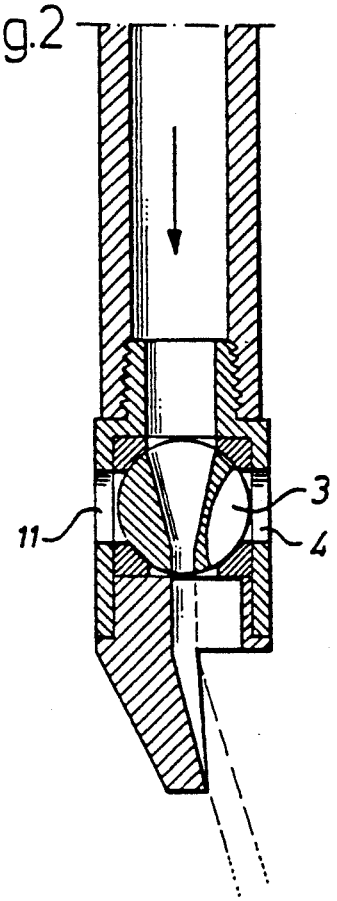
FIG. 2 is a corresponding section perpendicular to the section in FIG. 1.

A rotatable element 2 is journalled with the spray body 5 between seals 8 and formed with a substantially conical through hole 1. In the normal operation position of the nozzle as shown in FIGS. 1 and 2, the larger opening of the hole 1 is aligned with the spray tube 10.

As shown in FIGS. 2–5, on one side of the rotatable element 2 is formed a groove 3 capable of forming a passageway within the nozzle head 5 between the spray tube 10 and hole 4 formed in the side of the nozzle head.

In the embodiment shown, a control rod 7 is inserted in the rotatable element 2 and provided with a handle 6 arranged for the rotation of the rotatable element 2.

Figure 3:
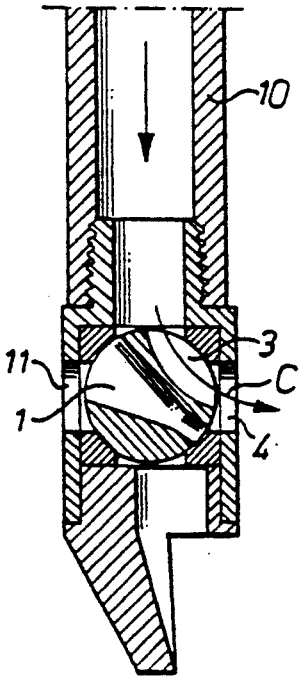
FIGS. 3–5 illustrate in corresponding sections as FIG. 2 different cleaning positions.
Figure 4:
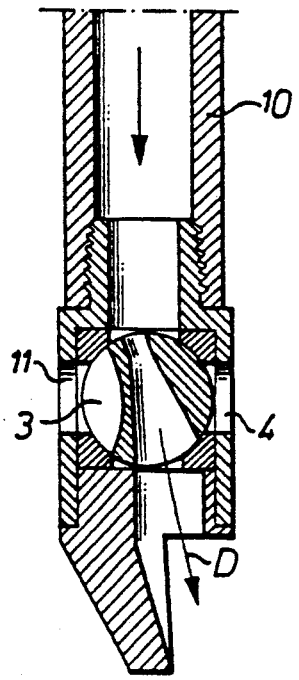
Figure 5:
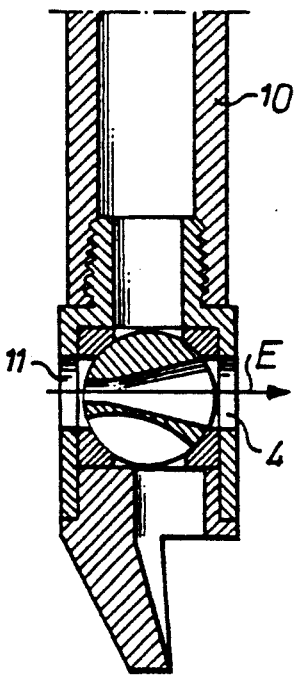

FIGS. 3 and 4 illustrate different positions of rotation for the rotatable element 2 for cleaning the spray tube and the nozzle while the sprayer is being operated. In the position shown in FIG. 3, the tube 10 is cleaned by flushing via the groove 3 and the hole 4 by means of existing system pressure in the tube (arrow C). By rotating the rotatable element 2 to the position shown in FIG. 4, the smaller opening of the conical hole 1 is facing the tube 10, and any debris in the conical hole can be flushed out (arrow D) by means of the system pressure in the tube 10. After cleaning the tube and the nozzle, the rotatable element 2 is rotated to the original operating position (FIGS. 1 and 2). A desired spray pattern can be obtained by adjusting the spray shaping element 9.

As shown in the embodiment according to FIGS. 1–5, a hole 11 in the spray head 5 can be made opposite the hole 4. The purpose of hole 11 is to permit removal of a plug in the conical hole 1 in the event that the plug should not be released upon flushing as shown in FIG. 4. The rotatable element 2 is then rotated to the position shown in FIG. 5 and a plug in hole 1 can be manually removed in the direction of arrow E.

Figure 6:
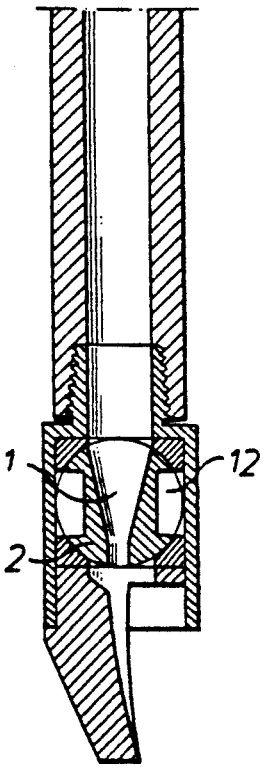
FIGS. 6 and 7 illustrate another embodiment of a nozzle according to the invention.
Figure 7:
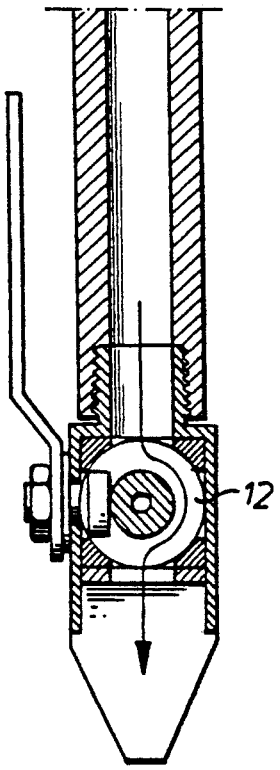

FIGS. 6 and 7 illustrate another embodiment of a nozzle according to the present invention. This nozzle structurally differs from the embodiment according to FIGS. 1–5 in that the rotatable element 2 is formed with an annular groove 12 instead of the groove positioned on one side of the conical hole 1. Cleaning of the conical hole takes place essentially in the same manner as in the previous embodiment. However, the cleaning of the tube 10 is not achieved by means of a hole made in the nozzle head. Instead, after the rotation of the rotatable element 2 through 90°, spray water is flushed through the spray jet outlet of the nozzle.

In the embodiments shown, the rotatable element consists of a ball. It can, however, also be formed in another way, for instance as a cylinder.

From an economic point of view, it should be noted that in a machine needing about 100 nozzles, the cost for an arrangement according to the present invention has been calculated to be about 20% of the cost normally associated with a conventional spray water filter or a bow sieve.

I claim:

1. A spray tube nozzle adapted to be cleaned during its operation, including a nozzle head having an inlet connectable to a conduit for spraying liquid and an outlet for said spraying liquid, in said nozzle head being located a rotatable means defining a through hole; said through hole having in one end a first opening of a relatively small cross-section and in an opposite end a second opening of a relatively large cross-section, said rotatable means sealingly arranged in said nozzle head and having an external groove, said rotatable means being positionable in at least a first rotational position for flow of said spraying liquid from said inlet through said through hole in a first direction for forming spray jets at said outlet, a second rotational position for flushing said conduit by flow of said spraying liquid from said inlet through said groove, and a third rotational position for flushing said through hole by flow of said spraying liquid from said inlet through said through hole in a second direction opposite to said first direction.

2. A nozzle as claimed in claim 1, wherein said external groove is positioned laterally of said through hole, said nozzle head having a first hole formed therein, said groove communicating with said inlet and said first hole in said second rotational position of said rotatable means.

3. A nozzle as claimed in claim 2, wherein said rotatable means is positionable in a fourth rotational position and said nozzle head having a second hole formed therein opposite to said first hole, said first hole and said second hole communicating through said through hole in said fourth rotational position of said rotatable means.

4. A nozzle as claimed in claim 1, wherein said external groove is an annular groove communicating with said inlet and said outlet in said second rotational position of said rotatable means.

5. A nozzle as claimed in claim 1, wherein said first opening of said through hole communicates with said inlet and said second opening of said through hole communicates with said outlet in said third rotational position of said rotational means.

6. A nozzle as claimed in claim 1, wherein said rotatable means comprises a ball.

7. A nozzle as claimed in claim 1, wherein means is provided outside said nozzle head for rotating said rotatable means.

8. A nozzle head according to claim 1, wherein said outlet comprises a replaceable spray shaping means.

* * * * *